US006260319B1

(12) United States Patent
Colomban

(10) Patent No.: US 6,260,319 B1
(45) Date of Patent: Jul. 17, 2001

(54) PROTECTIVE BARRIER

(75) Inventor: Massimo Colomban, Conegliano Veneto (IT)

(73) Assignee: Gennaker Holding S.A. (LU)

( * ) Notice: Subject to any disclaimer, the term of this patent is extended or adjusted under 35 U.S.C. 154(b) by 0 days.

(21) Appl. No.: 09/465,580

(22) Filed: Dec. 17, 1999

(30) Foreign Application Priority Data

Dec. 22, 1998 (IT) ..... TV98A0163

(51) Int. Cl.[7] ..... E04B 2/56

(52) U.S. Cl. ..... 52/404.1; 52/169.1; 52/169.2; 52/144; 52/28; 52/302.1; 52/302.3; 47/48.5; 47/82

(58) Field of Search ..... 52/404.1, 144, 52/145, 27, 28, 33, 533, 527, 302.1, 302.3, 173.3, 233, 169.1, 169.2; 181/284, 288, 290, 292; 40/564; 47/48.5, 82, 83

(56) References Cited

U.S. PATENT DOCUMENTS 3,183,624 * 5/1965 Swett ..... 47/66
3,702,045 * 11/1972 Selvaag ..... 52/58
3,821,863 * 7/1974 Chan ..... 47/48.5
3,954,263 * 5/1976 Whelan et al. ..... 273/33
4,373,308 * 2/1983 Whittaker ..... 52/173
4,870,781 * 10/1989 Jones ..... 47/43
4,986,027 * 1/1991 Harvey ..... 47/59
5,373,661 * 12/1994 Furukawa ..... 47/66
5,996,279 * 12/1999 Zayeratabat ..... 47/48.5
6,021,612 * 2/2000 Dunn et al. ..... 52/144
6,112,456 * 9/2000 Rummins ..... 47/48.5

* cited by examiner

*Primary Examiner*—Carl D. Friedman
*Assistant Examiner*—Phi Dieu Tran A
(74) *Attorney, Agent, or Firm*—Greer, Burns & Crain, Ltd.

(57) ABSTRACT

A protective barrier comprising a footing which is buried in the ground and supports a frame for supporting one or more panels. The panels internally comprise sound-deadening and/or air-filtering material and are constituted so as to have at least one finely perforated lateral surface, a finely perforated upper surface for collecting rainwater and a finely perforated bottom.

8 Claims, 4 Drawing Sheets

PROTECTIVE BARRIER

BACKGROUND OF THE INVENTION

The present invention relates to a protective barrier which can also be employed as cladding for walls or as cladding for the footing of buildings.

Nowadays it is known to provide protective barriers which are arranged next to roads or railroads and are used in particular to reduce the transmission of noise or to prevent any mutual dazzling occurring between cars traveling in opposite directions.

These conventional protective barriers are usually constituted by a footing which is usually buried in the ground and supports a frame between which for example suitable flat panels are arranged. Such panels can be internally empty, in order to prevent only the passage of light, or can be internally provided with sound-deadening material and with a finely perforated panel surface so as to reduce noise transmission.

However, these conventional protective barriers are substantially of the passive type and are used exclusively, and to a limited extent, in order to provide barriers to light or provide partial noise absorption, as above-mentioned, whereas the problem of atmospheric pollution is much more strongly felt, especially along roads.

SUMMARY OF THE INVENTION

The aim of the present invention is to solve the above-described problem, eliminating the drawbacks of the cited prior art and providing a barrier which can be applied for example alongside roadways or railroads or even optionally along borders or as walls, and which allows to achieve good light shielding, good sound deadening, filtering of dust and/or pollutants present in the air, and protection or decoration.

Within the scope of this aim, an important object of the present invention is to provide a protective barrier which is structurally simple and despite the above-noted air treatment can be regenerated to its optimum conditions rapidly and easily.

A further important object is to provide a protective barrier which associates with the preceding characteristics the possibility of disposing, in a controlled manner, of any absorbed volatile pollutants.

A further important object is to provide a protective barrier which can also be employed as an alternative energy source.

This aim, these objects and others which will become apparent hereinafter are achieved by a protective barrier according to the present invention which comprises a footing which is buried in the ground and supports a frame for supporting one or more panels, characterized in that said one or more panels are internally provided with sound-deadening and/or air-filtering materials, said one or more panels further comprising at least one finely perforated lateral surface, a finely perforated upper surface for collecting water and a finely perforated bottom.

BRIEF DESCRIPTION OF THE DRAWINGS

Further characteristics and advantages of the present invention will become apparent from the following detailed description of a particular but not exclusive embodiment, illustrated only by way of non-limitative example in the accompanying drawings, wherein.

DESCRIPTION OF THE PREFERRED EMBODIMENTS

Figure 1:
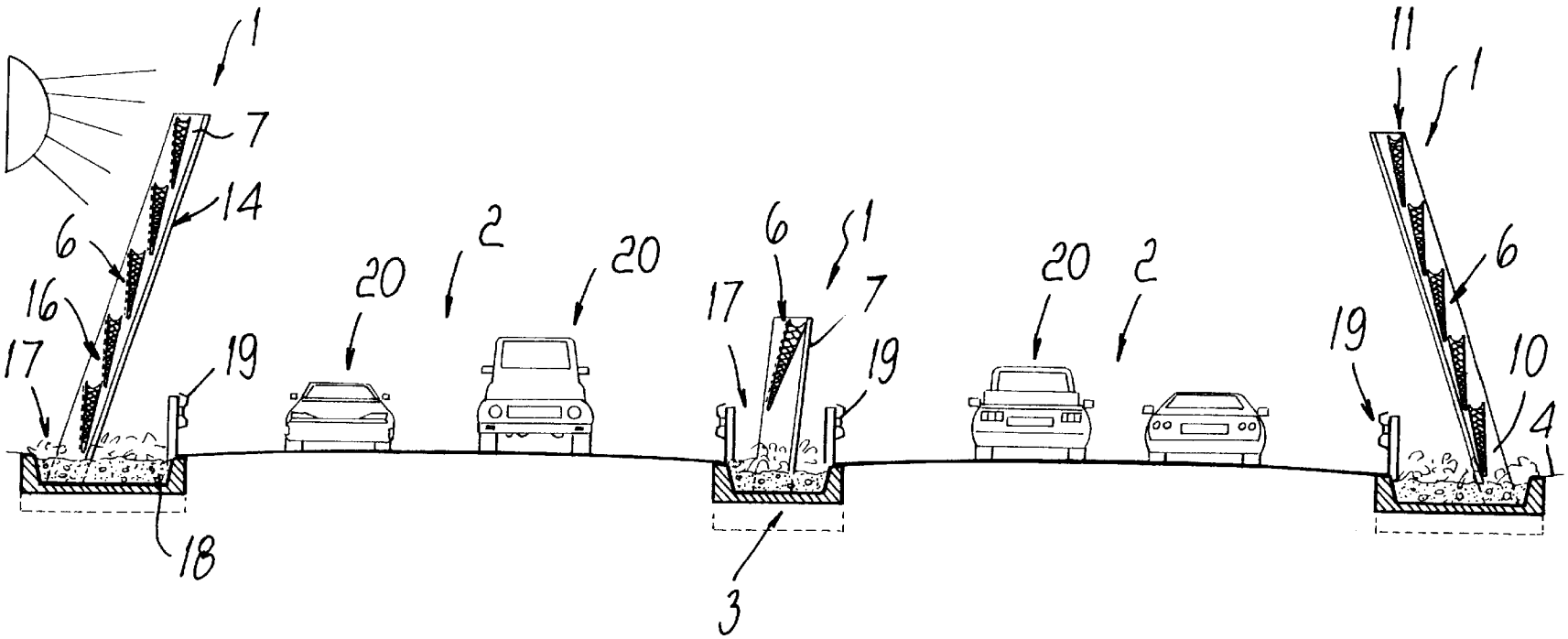
FIG. 1 is a front view of a possible arrangement of protective barriers of the invention alongside a roadway, wherein the barrier is shown in cross-section along a transverse plane for the sake of clarity.
Figure 2:
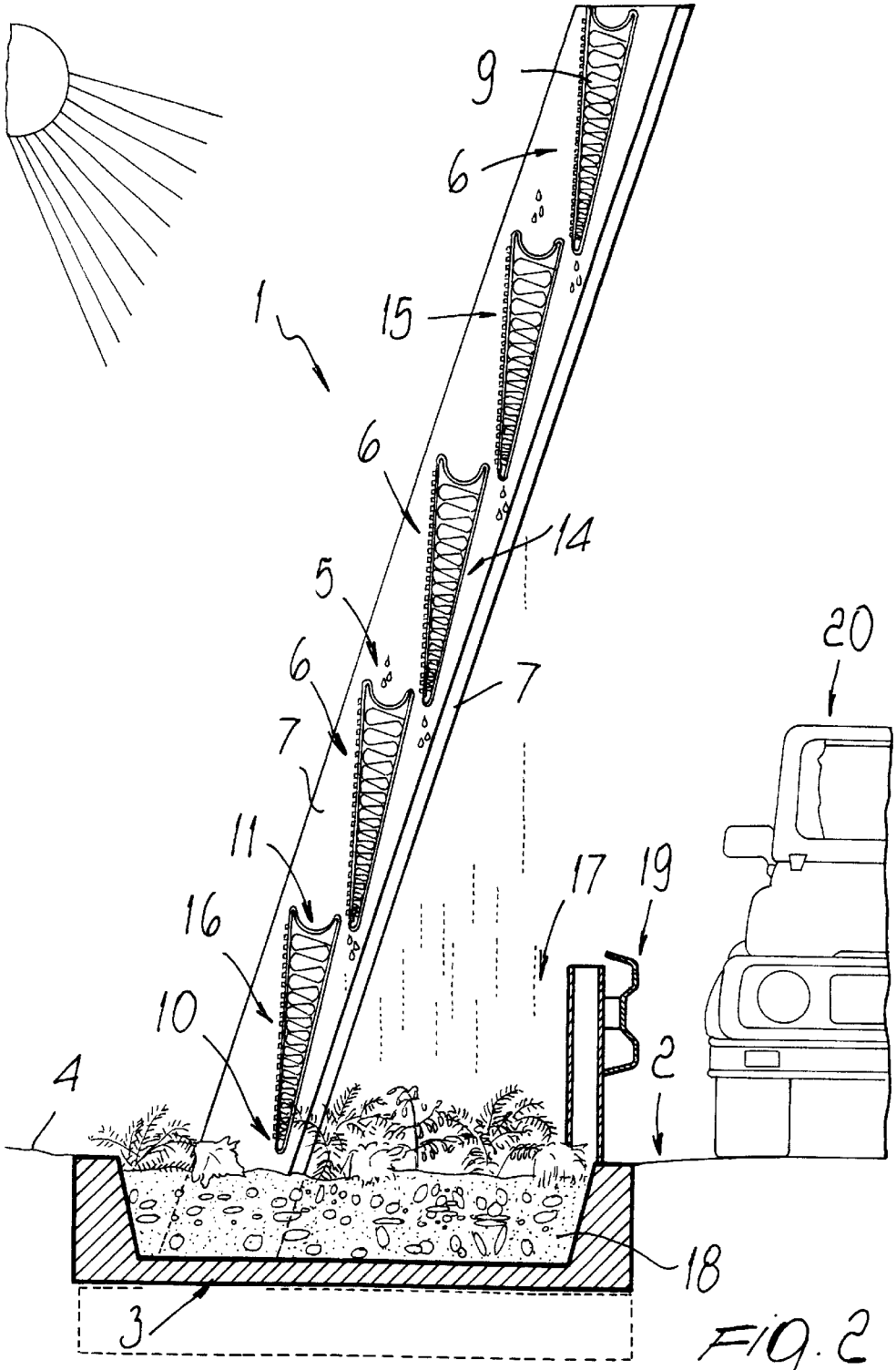
FIG. 2 is a more detailed view of the protective barrier of the invention, in the condition in which it is arranged outside the roadway.
Figure 3:
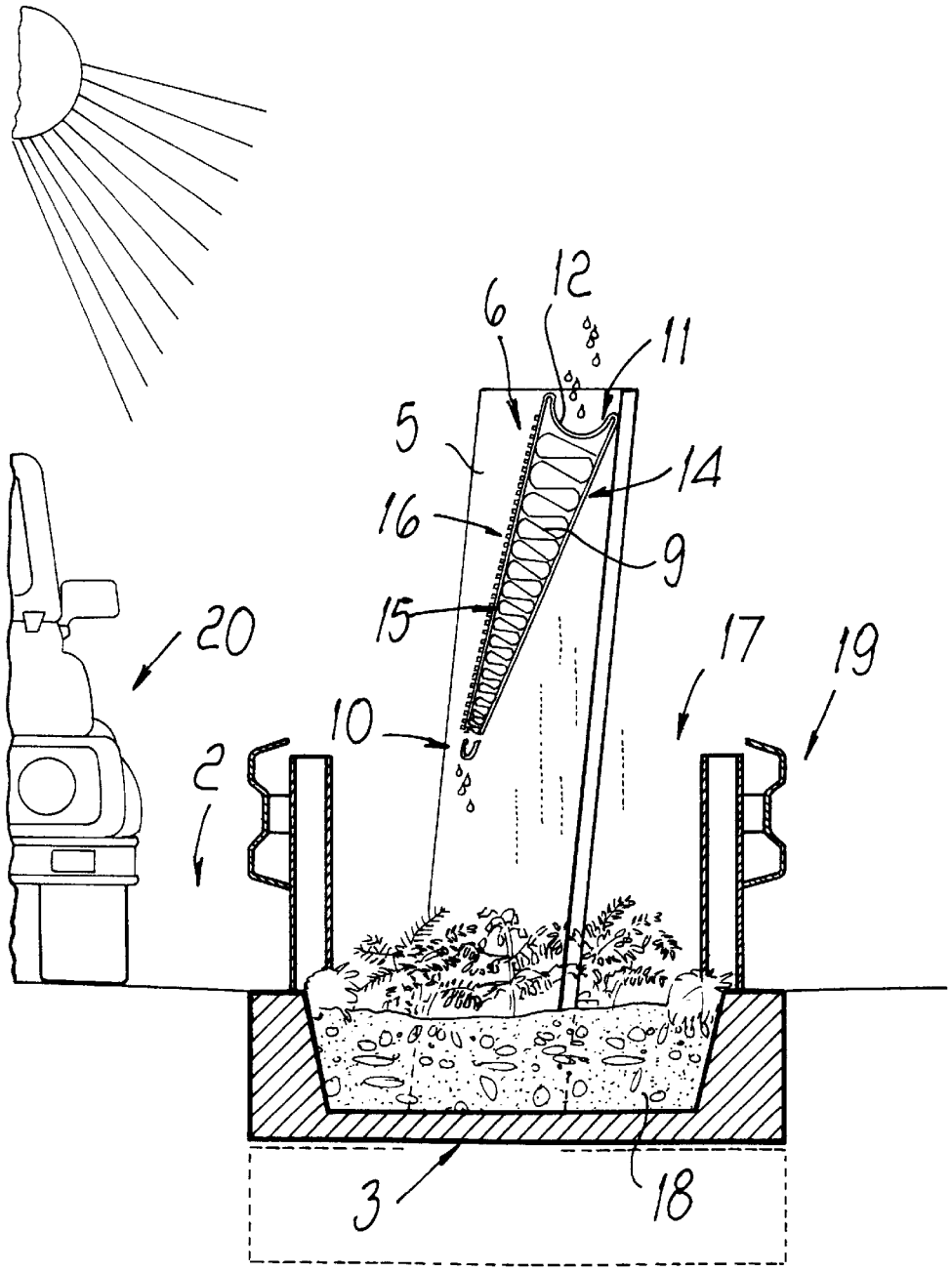
FIG. 3 is a view, similar to FIG. 2, of the protective barrier of the invention arranged in an intermediate region between two roadways.
Figure 4:
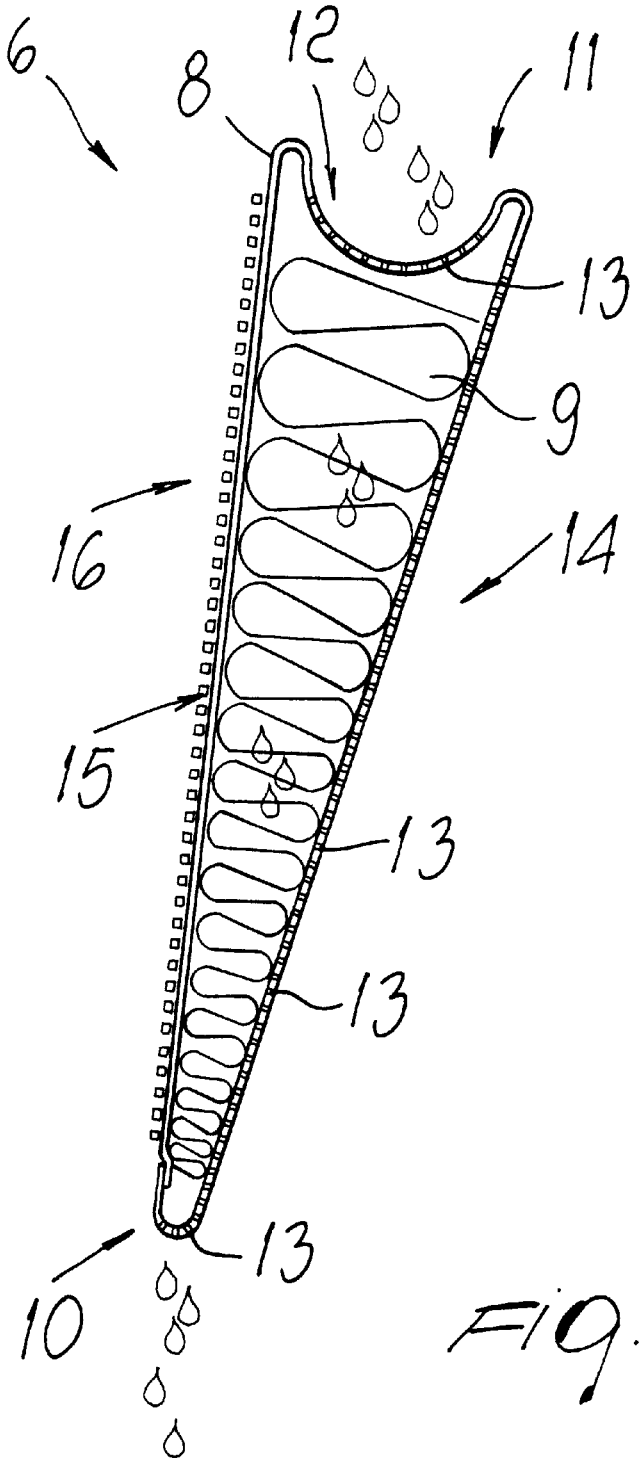
FIG. 4 is a sectional view, taken along a transverse plane, of a single panel of the barrier according to the invention.

With reference to the above figures, the numeral 1 designates a protective barrier, which is particularly used at regions located alongside a roadway, generally designated by the reference numeral 2, or in an intermediate region between two adjacent roadways.

As an alternative, the protective barrier can be applied for example along borders or in any case wherever it is necessary to provide noise reduction, air treatment, light transmission blocking or where it is necessary to place an alternative power source.

The protective barrier is preferably constituted by a footing 3 which is constituted by concrete, optionally reinforced concrete, which is anchored at the ground 4 in a region adjacent to a roadway or in the region interposed between two adjacent roadways.

The footing 3 constitutes the support for a frame, generally designated by the reference numeral 5, for supporting one or more panels, designated by the reference numeral 6.

The frame 5 is preferably but not necessarily constituted by two pillars 7 which are advantageously arranged at an angle, as observed hereinafter, and between which panels 6 are transversely interposed.

The panels are advantageously constituted by one or more metal sheets 8, for example made of steel, which form a box-like structure inside which it is possible to arrange material, designated by the reference numeral 9, which has sound-deadening and/or air-filtering and/or air-treating characteristics.

In the particular embodiment, the panels 6 are substantially V-shaped, with the vertex 10 directed toward the ground 4 and the base 11 provided with an arc-like shape which curves toward the vertex or bottom 10 so as to form an upper surface 12 for collecting rainwater or water sprayed thereon by suitable personnel assigned to maintenance.

The upper surface 12 and the vertex or bottom 10 are also finely perforated, since a plurality of through holes 13 are provided.

Moreover each panel 6 has a first lateral surface 14 which is directed toward the adjacent carriage and which is also finely perforated again by having a plurality of holes 13.

Each panel 6 also has a second lateral surface 15 which is optionally not perforated and on which a plurality of photovoltaic cells 16 can be arranged.

The arrangement of the panels 6 is such that the second lateral surface 15 is directed so as to optimize the incidence of the light on the photovoltaic cells, whereas each panel 6 is arranged so that its vertex or bottom 10 is adjacent to, and therefore in contact with, the base 11 of another panel 6.

The photovoltaic cells 16 are of course appropriately interconnected and interleaved with adapted devices for collecting, conveying, optionally storing or transmitting the energy obtained.

The energy thus produced can be employed to supply, either directly or even by means of batteries and accumulators for storing said energy, even for road lighting or for continuous or point-shaped lights arranged for example along the path in order to assist driving systems in case of fog or remotely-assisted driving systems.

A water collection channel 17 can be advantageously formed below the frame 5 and can allow a chosen and targeted conveyance of the water or may contain a suitable soil 18 at which one might cultivate suitable plants which for example feed on the pollutant compounds collected, as specified hereafter, by the individual panels and carried by rainwater.

The channel 17 can of course be part of the footing 3 and can optionally support suitable guardrails 19 provided in any way.

The invention is used as follows: once the protective barrier 1 has been installed, thanks to the presence of the fine perforation on its surfaces it can absorb for example volatile polluting compounds and/or dust present in the air and generated by the passage of cars 20, the compounds being retained by the appropriately provided material 9 contained in each individual panel 6.

The panels 6 also allow to achieve optimum noise reduction in addition to blocking the passage of the light beam for example from one roadway to the other during the transit of two cars 20 traveling in opposite directions.

In case of rain, and therefore of an atmospheric event, or if provided by the personnel assigned to maintenance, each panel 6 collects, at the arc-like base 11, the water which, through the holes 13, penetrates into the interior of each panel, washing the material 9 and therefore conveying for example the pollutant compounds to the vertex or bottom 10 and then discharging them into the underlying channel 17.

Moreover, the channel 17 collects all the other pollutant components that are present on, or are discharged onto, the roadway or road surface, conveying them during the next rainfall in order to treat them.

The optional presence of natural plants which feed on the pollutant compounds allows to dissolve and/or treat said pollutants; as an alternative, the channel 17 allows to convey the water at suitable devices for treating it.

It has thus been observed that the present invention has achieved the intended aim and objects, a protective barrier having been obtained which allows to reduce noise, to prevent the passage of light beams and to absorb part of the pollutant volatile compounds that are present in the air and are therefore caused by the emissions of vehicles, dust, tire wear, etcetera, with the possibility of retaining these components and of self-regenerating each individual panel in case of rain.

Moreover, thanks to the presence of the channel located below the protective barrier, it is possible to appropriately collect and treat the water that contains the associated pollutant compounds.

Moreover, the possibility to provide a lateral surface of each panel with photovoltaic cells allows to collect electric power from an alternative source. Such power can be, for example, partly transferred to nearby homes, accordingly covering part of the energy costs, or can be supplied to street lighting or electric grids or active networks for automatic or assisted driving.

The invention is of course susceptible of numerous modifications and variations, all of which are within the scope of the same inventive concept.

Thus, for example, the configuration of the individual panel may be the most pertinent, so that for example it can have a plurality of rainwater collection bases 11 arranged on the same plane or on different planes; likewise, the configuration of the first and second lateral surfaces and of the vertex or bottom 10 can also be of any kind.

The arrangement of the panels at the frame 5 may also be the most appropriate according to specific requirements.

The disclosures in Italian Patent Application No. TV98A000163 from which this application claims priority are incorporated herein by reference.

What is claimed is:

1. A protective barrier, comprising a footing which is buried in the ground and supports a frame supporting one or more panels, wherein said one or more panels are internally provided with at least one of sound-deadening, air-filtering and air-treating materials, said one or more-panels further comprising at least one finely perforated lateral surface, a finely perforated upper surface for collecting water and a finely perforated bottom wherein said frame is constituted by two pillars, said pillars being arranged vertically or at an angle.

2. The protective barrier according to claim 1, wherein said one or more panels are constituted by one or more metal sheets which form a box-like structure inside which the material is arranged.

3. The protective barrier according to claim 1, wherein said one or more panels have an essentially V-like or box-like shape, in which the bottom is directed toward the ground and a base has an arc-like configuration which is directed toward said bottom so as to form an upper surface for collecting water.

4. The protective barrier according to claim 3, wherein said upper surface and said bottom are finely perforated due to the presence of a plurality of through holes so as to allow an outflow of liquids present inside said panel.

5. The protective barrier according to claim 4, wherein each one of said one or more panels has a first lateral surface which is directed toward an adjacent roadway and is also finely perforated.

6. The protective barrier according to claim 5, wherein each one of said one or more panels has a second lateral surface which is not perforated and on which a plurality of photovoltaic cells are arranged.

7. The protective barrier according to claim 6, wherein each one of said one or more panels is arranged so that said second lateral surface is in a position which optimizes the incidence of light on said photovoltaic cells, whereas each panel is arranged so that its bottom is adjacent to, and therefore in contact with, said base of another panel.

8. The protective barrier according to claim 1, wherein below said frame there is provided at least one water collection channel which allows an intended and targeted conveyance of the water, or contains a suitable soil at which plants are cultivated which feed on pollutant compounds collected by said panels and conveyed by the water.

* * * * *

UNITED STATES PATENT AND TRADEMARK OFFICE

CERTIFICATE OF CORRECTION

PATENT NO. : 6,260,319 B1
DATED : July 17, 2001
INVENTOR(S) : Colomban

It is certified that error appears in the above-identified patent and that said Letters Patent is hereby corrected as shown below:

Title page,
Item [30], Foreign Application Priority Data, delete "TV98A0163" and insert -- TV98A000163 --.

Signed and Sealed this

Nineteenth Day of November, 2002

*Attest:*

*Attesting Officer*

JAMES E. ROGAN
*Director of the United States Patent and Trademark Office*